US009021921B2

(12) United States Patent
Ogata et al.

(10) Patent No.: US 9,021,921 B2
(45) **Date of Patent: *May 5, 2015**

(54) TORQUE WRENCH

(75) Inventors: Tomohiro Ogata, Ota-ku (JP); Koichi Shimura, Ota-ku (JP); Yuji Kato, Ota-ku (JP); Shozo Aikawa, Ota-ku (JP); Hiroshi Tsuji, Ota-ku (JP)

(73) Assignee: Tohnichi Mfg. Co. Ltd., Toko (JP)

( * ) Notice: Subject to any disclaimer, the term of this patent is extended or adjusted under 35 U.S.C. 154(b) by 863 days.

This patent is subject to a terminal disclaimer.

(21) Appl. No.: 13/138,732

(22) PCT Filed: Feb. 16, 2010

(86) PCT No.: PCT/JP2010/000921

§ 371 (c)(1),
(2), (4) Date: Sep. 22, 2011

(87) PCT Pub. No.: WO2010/119598

PCT Pub. Date: Oct. 21, 2010

(65) Prior Publication Data

US 2012/0011971 A1 Jan. 19, 2012

(30) Foreign Application Priority Data

Apr. 16, 2009 (JP) ..... 2009-100059

(51) Int. Cl.
*B25B 13/00* (2006.01)
*B25B 23/14* (2006.01)
*B25B 23/142* (2006.01)

(52) U.S. Cl.
CPC ..... *B25B 23/1427* (2013.01); *B25B 13/00* (2013.01); *B25B 23/14* (2013.01); *B25B 23/141* (2013.01)

(58) Field of Classification Search
CPC ..... B25B 13/00; B25B 23/157
USPC ..... 81/59.1, 467, 52, 473, 183
See application file for complete search history.

(56) References Cited

U.S. PATENT DOCUMENTS 8,443,702 B2 * 5/2013 Kan et al. ..... 81/467
2006/0102442 A1 5/2006 Dein
2008/0276762 A1 11/2008 Dein

FOREIGN PATENT DOCUMENTS

JP U H07-40070 7/1995

*Primary Examiner* — Monica Carter
*Assistant Examiner* — Danny Hong
(74) *Attorney, Agent, or Firm* — Manabu Kanesaka

(57) ABSTRACT

A torque wrench equipped with a cam-type torque detection mechanism is provided which is capable of detecting a torque with high accuracy, providing a non-unusual-feeling of handle operation after torque has been detected, and enabling tightening of fastened members such as bolts with safety. In a torque wrench equipped with the cam-type torque detection mechanism, a cam portion 27 formed on the outer circumference of a tubular cam 22 includes: a static engagement cam surface 27*a* with which a roller member 18 in a static status engages in a non-operated status; a gradually increasing torque peak cam surface 27*b* which is connected to the static engagement cam surface 27*a* and with which the roller member 18 is brought into contact while moving to thereby gradually increase the torque peak value; a cam top surface 27*c* forming the cam top portion continued to the gradually increasing torque peak cam surface 27*b*; a gradually decreasing torque cam surface 27*d* for gradually decreasing a plus torque to the roller member 18 to zero; and a minus torque cam surface 27*e* for imparting a minus torque to the roller member 18 having passed over the gradually decreasing torque cam surface 27*d*.

7 Claims, 2 Drawing Sheets

TORQUE WRENCH

RELATED APPLICATIONS

The present application is National Phase of International Application No. PCT/JP2010/000921 filed Feb. 16, 2010, and claims priority from Japanese Applications No. 2009-100059, filed Apr. 16, 2009.

TECHNICAL FIELD

The present invention relates to a torque wrench, and more particularly to a torque wrench with a mechanical torque detection mechanism which provides the operator with a feeling of operation of an applied force being suddenly reduced when the tightening torque has reached a set torque value.

BACKGROUND ART

As a mechanical torque detection mechanism for torque wrenches, there has been suggested a cam-type torque detection mechanism with a cam and a cam roller that is brought into resilient contact with the cam by a spring (Patent Document 1).

FIG. 3(*a*) shows a torque wrench with the aforementioned conventional cam-type torque detection mechanism. The torque wrench shown in FIG. 3(*a*) has a tubular head 52 fixed to the front end of a tubular handle 51, and a drive spindle 53 which is rotatably mounted in the head 52 allowing a socket (not shown) or the like to be replaceably mounted thereon. Furthermore, the head 52 is provided therein with a tubular cam 54 which is concentric with the center axis of the drive spindle 53 and rotatably mounted on the outer circumference of the drive spindle 53 with a gap in between. The tubular cam 54 has ratchet teeth 55 on its inner-circumferential surface and four cam portions 56 on its outer circumferential portion along the circumference. Furthermore, the drive spindle 53 is provided, on its outer circumference, with engaging pawls 57 for engagement with the ratchet teeth 55 to serve as a ratchet mechanism. The ratchet mechanism allows the engaging pawls 57 to engage with the ratchet teeth 55 by springs 58, so that the engaging pawls 57 engage with the ratchet teeth 55 when the tubular cam 54 is rotated in the clockwise direction. This makes it possible to integrate the tubular cam 54 with the drive spindle 53, allowing the applied force on the handle 51 to tighten a bolt (not shown) or the like. Note that the ratchet mechanism allows the tubular cam 54 to freely rotate in the counterclockwise direction.

In the handle 51, there is provided a pressing spring 59 for setting torque values and pressing a thrust member 60 disposed at the front end of the handle 51 towards the center axis of the head 52. Between the thrust member 60 and the outer circumferential surface of the tubular cam 54, there is disposed a roller 61 which is rotatable about its own axis. Furthermore, the roller 61 is made freely movable in the longitudinal direction or along the axis L0, so that the spring-actuated thrust member 60 exerts a thrust force to push the roller 61 against the cam portion 56.

In the torque wrench configured as such, suppose that an operational force is applied to the handle 51 in the clockwise direction to tighten a bolt. In this case, if the reactive force exerted on the roller 61 from the contact surface of the cam portion 56 is less than the thrust force received by the roller 61 from the pressing spring 59, then the tubular cam 54 rotates integrally with the handle 51 thereby turning the drive spindle 53. Then, the reactive force increases as the tightening torque increases. When the roller 61 is pushed back towards the cam top of the cam surface against the spring force of the pressing spring 59, the roller 61 reaches a torque peak position P to detect a torque (it is detected that the torque has reached the set value).

As shown in FIG. 3(*b*), the cam portion 56 or a curved cam surface is made up of: a roller static engagement cam surface 56*a* of an abrupt slope having a curved surface of radius R0 that agrees with the curved surface of the roller 61 (radius R0); a minus torque cam surface 56*b* of a gradual slope having a curved surface of radius R2; and a cam top surface 56*c* with a curved surface of radius R1 formed in between, disposed continuously to or from the roller static engagement surface 56*a*. Here, the connecting point between the roller static engagement cam surface 56*a* and the cam top surface 56*c* is the torque peak position P.

PRIOR ART DOCUMENTS

Patent Documents

[Patent Document 1] UK Patent No. 2148767

DISCLOSURE OF INVENTION

Problem to be Solved by the Invention

In a non-operated status of the conventional torque wrench shown in FIG. 3, no applied force is exerted on the torque wrench, so that the roller 61 is at standstill while being fit on the curved surface of the roller static engagement cam surface 56*a*. Then, immediately after the roller 61 has started to move, the roller 61 moves over the torque peak position P to detect a torque. That is, the detection of torque is to be performed when the roller 61 shifts its status from the static friction status to a kinetic friction status relative to the cam surface of the cam portion 56.

The connecting point between the curved roller static engagement cam surface 56*a* and the curved cam top surface 56*c* is set at the torque peak position P in that manner. Thus, when there occurs a variation in the cam shape of the roller static engagement cam surface 56*a* and the cam top surface 56*c* or the roller is displaced off the center of rotation thereof due to wear of the roller spindle or the like, a torque cannot be detected with high accuracy.

Furthermore, the torque peak is to be detected at the instant at which the roller 61 has changed from the static friction status to a kinetic friction status. Thus, a torque cannot be detected with high accuracy due to variations in the force exerted on the roller 61 during transition from the static friction status to the kinetic friction status.

On the other hand, on the uphill slope from the torque detection position P to the cam top position of the cam top surface 56*c*, the force along the tangent L1 exerted on the roller 61 from the cam top surface 56*c* is small and opposite to the direction of tightening action. Then, when having passed over the cam top, the roller 61 is brought into contact with the minus torque cam surface 56*b* of a downhill slope. This causes the roller 61 to be subjected to the tangent L1 force from the minus torque cam surface 56*b* in the direction of the tightening action.

That is, during a tightening operation, the operator applies a strong force to the handle 51 in the direction of the tightening action. Then, immediately after the roller has passed over the torque peak position P, the reactive force exerted on the handle 51 is abruptly reduced. Furthermore, the handle 51 is subjected to the rotational force in the direction of the tightening action due to the spring force of the pressing spring 59.

As such, immediately after the torque peak is reached, the handle 51 is subjected to the rotational force in the direction of the tightening operation. This does not only ruin the operability of the wrench but also may cause injury to the operator due to an increased rotational force exerted on the handle 51 which results from the spring force of the pressing spring 59 being increased with increasing detected torque values.

An object of the present invention is to provide a torque wrench with a cam-type torque detection mechanism which can solve such conventional problems and detect a torque with high accuracy.

Another object of the present invention is to provide a torque wrench with a cam-type torque detection mechanism which can provide a non-unusual-feeling of handle operation after a torque has been detected, and which enables tightening of fastened members such as bolts with safety.

Means for Solving Problem

The arrangement to implement an object of the present invention is a torque wrench which includes a cam-type torque detection mechanism. The torque detection mechanism has a rotatable drive spindle for transmitting tightening force to a tightened member, a tubular cam disposed rotatably around the drive spindle via a ratchet mechanism and provided on its outer circumferential surface with a cam portion, and a roller member actuated by a resilient member to abut retreatably against the cam portion, the roller member being subjected to the tightening force. The torque wrench is characterized in that the cam portion has a static engagement cam surface for engagement in a non-operated status by the roller member in a static status, and a gradually increasing torque peak cam surface which is connected to the static engagement cam surface and with which the roller member is brought into contact while moving to thereby gradually increase a torque peak.

The configuration to implement another object of the present invention is a torque wrench which includes a cam-type torque detection mechanism. The torque detection mechanism has a rotatable drive spindle for transmitting tightening force to a tightened member, a tubular cam disposed rotatably around the drive spindle via a ratchet mechanism and provided on its outer circumferential surface with a cam portion, and a roller member actuated by a resilient member to abut retreatably against the cam portion, the roller member being subjected to the tightening force. The torque wrench is characterized in that the cam portion has a cam top surface serving as a cam top portion for guiding the roller member after having passed the torque peak position, a gradually decreasing torque cam surface connected to the cam top surface for gradually decreasing a plus torque to zero to the roller member, and a minus torque cam surface for imparting a minus torque to the roller member after having passed over the gradually decreasing torque cam surface.

Effect of the Invention

According to the invention of claim 1, a torque can be detected with high accuracy because a torque peak can be detected in a kinetic friction status. A torque can also be detected with high accuracy even when there is a variation in the shape of the cam or the roller member is off-centered, e.g., due to wear of the spindle of the roller member. This is because the maximum torque peak value is obtained within the range of the rotational angle of the roller member with respect to the gradually increasing torque peak cam surface.

According to the invention of claim 2, the roller member passes over the gradually decreasing torque cam surface after the maximum torque peak. This allows a slight load to act upon the operator and thus provide a signal to alert the operator to the completion of the tightening action, so that the operator can then stop applying the tightening force. Thus, since the force is not suddenly released on the minus torque cam surface, it is possible to provide an improved feeling of operation during service and a secure torque wrench.

According to the invention of claim 3, it is possible to provide a torque wrench which includes the effects of claim 1 and claim 2.

According to the invention of claim 4, the gradually increasing torque peak cam surface that is made up of a straight locus facilitates the setting of a torque peak value and can be formed easily.

According to the invention of claim 5, the gradually decreasing torque cam surface that is made up of a straight locus facilitates the setting of a load resulting from the torque being gradually decreased and the setting of the rate of gradual decrease of torque.

BEST MODE(S) FOR CARRYING OUT THE INVENTION

Figure 1:
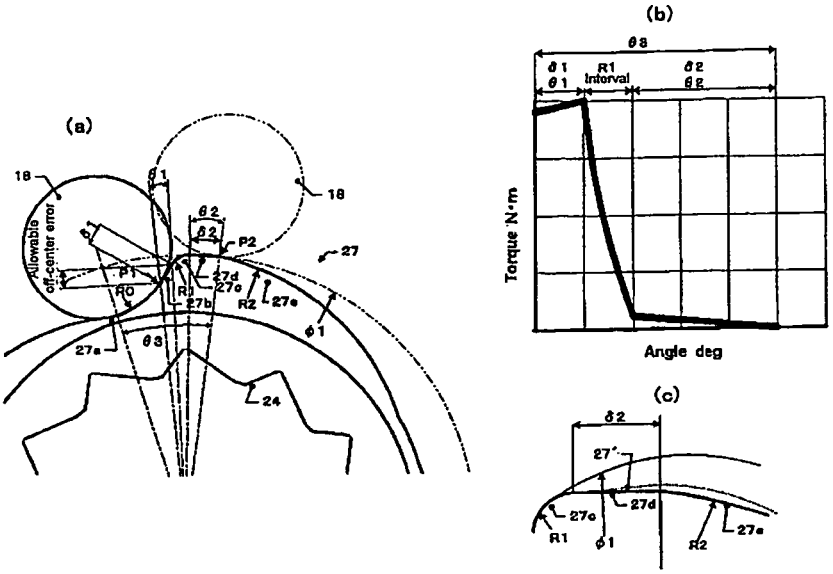
FIG. 1 shows a detailed view of the cam portion of a torque wrench according to an embodiment of the present invention and a torque versus angle diagram.

A description will now be made to the present invention in accordance with the embodiment illustrated in the drawings.

Figure 2:
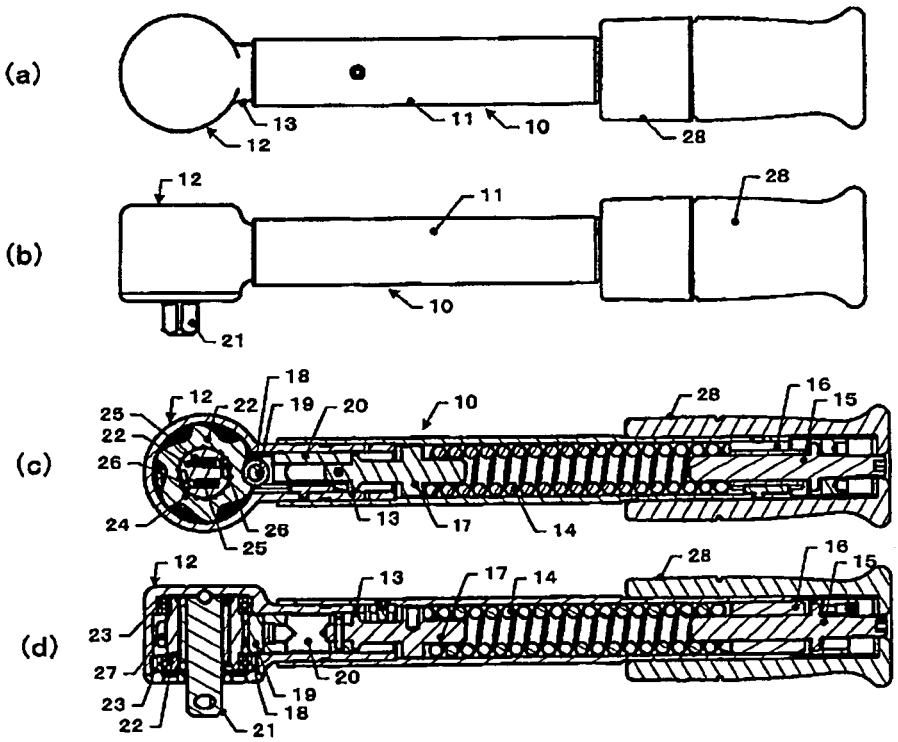
FIG. 2 shows the overall configuration of the torque wrench of FIG. 1, illustrating (a) a top plan view of its appearance, (b) a front view of its appearance, (c) a horizontal cross sectional view of (a), and (d) a vertical cross sectional view of (b).
Figure 3:
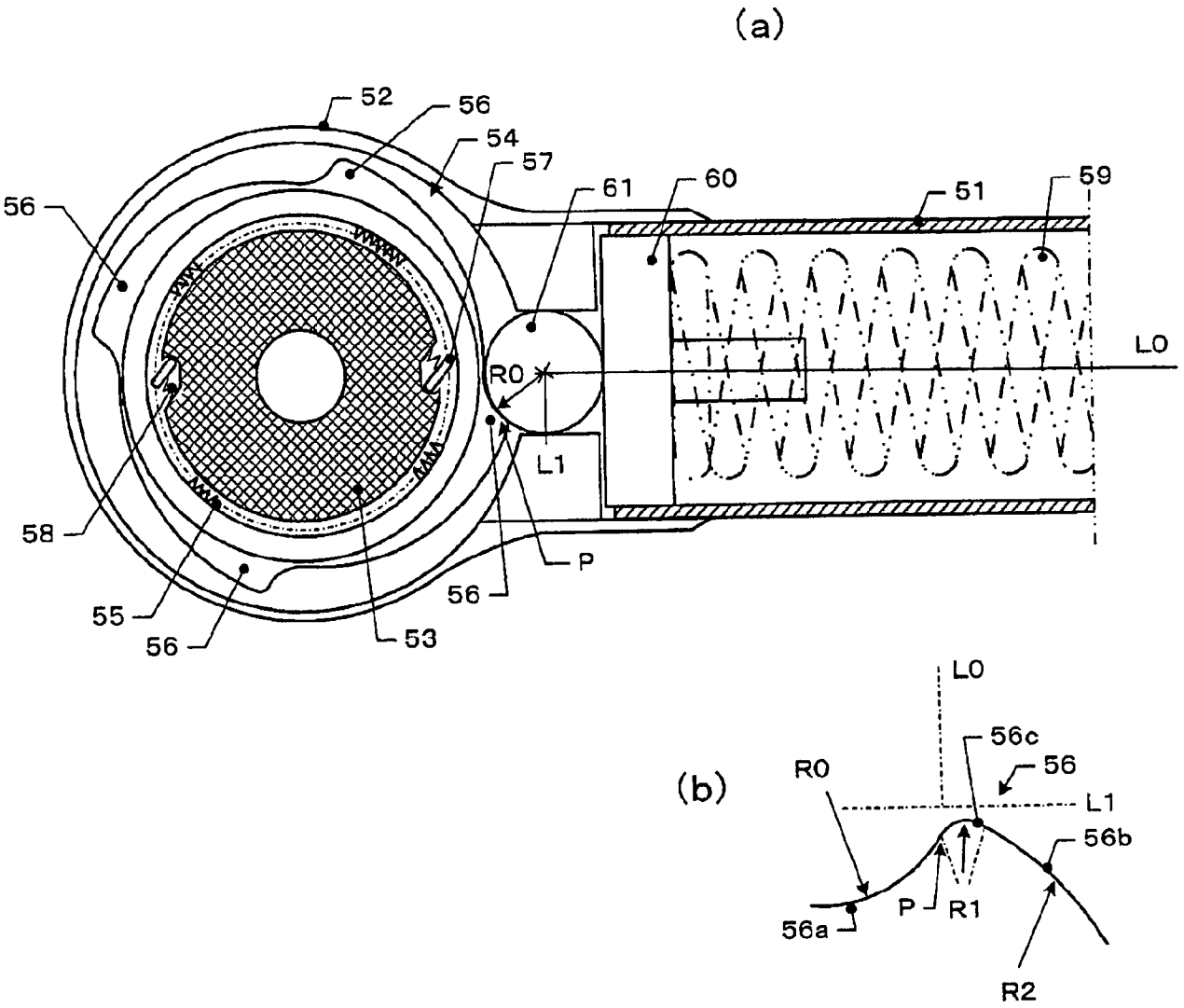
FIG. 3 shows a conventional cam-type torque wrench, illustrating (a) a horizontal cross sectional view of its main portion and (b) an enlarged view of the cam surface of (a).

FIG. 1(*a*) is a detailed view of the cam portion of a torque wrench according to an embodiment of the present invention, (b) showing a torque versus angle diagram for the cam portion illustrated in (a), (c) showing an enlarged view of a gradually decreasing torque cam surface of the cam portion in (a). FIG. 2 shows the overall configuration of the torque wrench of FIG. 1, illustrating (a) a top plan view of its appearance, (b) a front view of its appearance, (c) a horizontal cross sectional view of (a), and (d) a vertical cross sectional view of (b).

In FIG. 2, the present embodiment provides a torque wrench 10 with an outer structure in which a tubular head 12 is secured to the front portion of a tubular handle 11. The head 12 is fixed to the handle 11 by allowing a tubular screwing portion 13 extending backwards from the head 12 to be screwed to the threaded portion formed on the inner circumference of the front portion of the handle 11.

The handle 11 has a pressing spring 14 disposed therein. The handle 11 is provided in the rear end portion thereof with a torque adjusting mechanism with a bolt member 15 and a nut member 16 in which the bolt member 15 is rotated to move the nut member 16 in the axial direction. The nut member 16 contacts at its front end with the rear end of the pressing spring 14. There is provided a thrust member 17 which is mounted in the front end of the pressing spring 14, with the front end of the thrust member 17 inserted into the screwing portion 13. The front portion of the thrust member 17 is provided with a support member 20 for allowing a spindle 19 to rotatably support a roller member 18 disposed in the head 12. The support member 20 and the thrust member 17 can integrally move in the longitudinal direction (axial direction) of the handle 11.

In the head 12, there is rotatably provided a drive spindle 21 which has the rotational center axis orthogonal to the axial direction of the handle 11, with a tubular cam 22 rotatably disposed around the outer circumference of the drive spindle 21 via a gap in between. Note that annular roller bearings 23 are installed at the upper and lower portions of the tubular cam 22, respectively, thereby allowing the tubular cam 22 to be rotatably mounted within the head 12 via the upper and lower roller bearings 23.

The tubular cam 22 is provided on its inner circumferential surface with a plurality of ratchet teeth 24 in the circumferential direction, which form a ratchet mechanism together with ratchet pawls 26 disposed on the outer circumferential portion of the drive spindle 21 and actuated by a spring 25 toward the ratchet teeth 24. The ratchet mechanism is configured such that the drive spindle 21 rotates integrally with the tubular cam 22 in the clockwise direction.

On the outer circumferential portion of the tubular cam 22, a plurality of (in the present embodiment, six) cam portions 27 are formed at equal intervals along the circumference, so that the roller member 18 actuated by the pressing spring 14 is pressed against the cam portion 27.

The operator fits a socket (not shown) engaged with the drive spindle 21 over a tightened member (not shown) such as a bolt or nut and then holds a grip 28 of the handle 11 and rotates it in the clockwise direction. This causes the roller member 18 to abut against a cam portion 27 to rotate the tubular cam 22 in the clockwise direction as well as the drive spindle 21 to rotate integrally with the tubular cam 22 to tighten the fastened member. As the tightening torque starts to increase, the cam action between the cam portion 27 and the roller member 18 causes the roller member 18 to move backwards in the axial direction of the handle 11 against the spring force of the pressing spring 14. The operator then senses a decrease in the operational rotating force on the handle 11, thus detecting the torque that has reached the set torque value.

Now, referring to FIG. 1, a description will be made in detail to the cam portions 27.

As shown in FIG. 1(*a*), the roller member 18 rotates in the clockwise direction around the cam portion 27 to fasten a bolt or the like. The cam portions 27 are formed generally in a convex cam surface.

On the left cam surface of the cam portion 27, there is formed a static engagement cam surface 27*a* which has a curvature of RO or the same radius as the radius RO of the roller member 18, allowing the roller member 18 to engage with the static engagement cam surface 27*a*. In a non-operated status in which a tightened member such as bolts is not being fastened, the roller member 18 is pushed against the static engagement cam surface 27*a* by the spring force of the pressing spring 14 and held in engagement therewith. The static engagement cam surface 27*a* is formed in a concave shape and connected with a straightened segment δ1 or a gradually increasing torque peak cam surface 27*b*. Connected to the gradually increasing torque peak cam surface 27*b*, a convex curved surface of curvature R1 or a cam top surface 27*c* is formed as a cam surface of the radius (ϕ1) of the cam portion 27. In this case, the maximum torque peak is given at the connecting point P1 between the gradually increasing torque peak cam surface 27*b* and the cam top surface 27*c*. The rotational angle in which the roller member 18 rotates along the gradually increasing torque peak cam surface 27*b* is also given as the torque detection angle (θ1).

Thus, with the roller member 18 being engaged with the static engagement cam surface 27*a*, tightening force is applied to the handle 11 in the direction of tightening and increased. This causes the roller member 18 to start moving from the static engagement cam surface 27*a*, and then while rotating about its own axis, travel over the straightened gradually increasing torque peak cam surface 27*b* towards the maximum torque peak point . That is, the roller member 18 is shifted from a static friction status to a kinetic friction status, gradually increasing the torque detected. The torque peak is detected in a kinetic friction status, thereby making it possible to detect the maximum torque peak with high accuracy.

On the other hand, the cam height of the gradually increasing torque peak cam surface 27*b* can be employed as an allowable off-center error. That is, the height of the maximum torque peak has to be obtained only while the roller member 18 moves through the torque detection angle θ1. It is thus possible to detect a torque approximate to the proper maximum torque peak even when the center of the roller member 18 is off-centered due to wear of the spindle 19 of the roller member 18 or the like.

Then, since the maximum torque peak point is the connecting point P1 between the gradually increasing torque peak cam surface 27*b* and the cam top surface 27*c* of the curvature R1, the roller member moves over the convex cam surface of the curvature R1 after the maximum torque peak has been detected. Between the cam top surface 27*c* and a minus torque cam surface 27*e* or a curved surface of curvature R2 for imparting a minus torque to the roller member 18, there is provided a gradually decreasing torque cam surface 27*d* in the interval of a rotational angle θ2. As shown in FIG. 1(*c*), the gradually decreasing torque cam surface 27*d* is formed in a straight line of length δ1, imparting a plus torque to the roller member 18 until it reaches the connecting point P2 to the minus torque cam surface 27*e*. However, the gradually decreasing torque cam surface 27*d* is located inside the outer diameter of the cam portion 27 (radius ϕ1) and formed in such a locus that gradually comes inwardly from the outer diameter. Thus, the torque imparted by the roller member 18 to the gradually decreasing torque cam surface 27*d* is gradually reduced.

FIG. 1(*b*) shows the relationship between the rotational torque wrench angle (θ) and the torque from the start of a tightening action on a tightened member such as a bolt with the torque wrench 10 according to the present embodiment. The handle 11 is rotated to start moving the roller member 18 from the static engagement cam surface 27*a*. As the roller member 18 starts rotating around its own axis in the clockwise direction within the range of the rotational angle θ1 over the cam locus of a straight line distance δ1 of the gradually increasing torque peak cam surface 27*b*, the torque peak gradually increases. Then, at the point P1, the maximum torque or the set torque value is detected. When the roller member 18 has passed the point P1 and moves over the cam top surface 27*c* or a curved surface of the curvature R1, the reactive force acting upon the roller member 18 is abruptly reduced. While the roller member 18 moves to the straight locus point P2 on the gradually decreasing torque cam surface 27*d*, the torque exerted on the handle 11 is gradually reduced.

That is, conventionally, the roller member 18 having passed over the cam top surface 27*c* moves onto the locus of the minus torque cam surface 27*e*, and is subjected to a force in the tightening direction due to the spring force of the pressing spring 14, causing a minus torque to be immediately applied to the handle 11 in the tightening direction. However, according to the present invention, this can be avoided. The operator feels a slight load while the roller member moves over the gradually decreasing torque cam surface 27*d*. This can work as a kind of signal for the operator to stop applying the tightening force, so that the danger of an abrupt application of a minus torque can be avoided.

As described above, the angular range θ3 from the static engagement cam surface 27*a* to the point P2 is an interval of a plus torque. As the plus torque interval comes to an end, the operator can feel as a feeling of operation a gradual decrease in the tightening torque. As shown in FIG. 1(*c*), this feeling of operation can be varied in a manner such that the gradually-decreasing torque angle is changed by bringing the gradually decreasing torque cam surface 27*d* or a straight locus towards or away from the outer diameter side (27*e*') of the cam portion 27.

DESCRIPTION OF REFERENCE NUMERALS

10 torque wrench
11 handle
12 head
13 screwing portion
14 pressing spring
15 bolt member
16 nut member
17 thrust member
18 roller member
19 spindle
20 support member
21 drive spindle
22 tubular cam
23 roller bearing
24 ratchet teeth
25 spring
26 ratchet pawl
27 cam portion
- 27*a* static engagement cam surface
- 27*b* gradually increasing torque peak cam surface
- 27*c* cam top surface
- 27*d* gradually decreasing torque cam surface
- 27*e* minus torque cam surface

28 grip

The invention claimed is:

1. A torque wrench comprising a cam-type torque detection mechanism, the torque detection mechanism having: a rotatable drive spindle for transmitting tightening force to a tightened member, a tubular cam disposed rotatably around the drive spindle via a ratchet mechanism and provided on its outer circumferential surface with a cam portion, and a roller member actuated by a resilient member to abut retreatably against the cam portion, the roller member being subjected to the tightening force, the torque wrench characterized in that the cam portion has a static engagement cam surface for engagement in a non-operated status by the roller member in a static status, and a gradually increasing torque peak cam surface which is connected to the static engagement cam surface and with which the roller member is brought into contact while moving to thereby gradually increase a torque peak.

2. A torque wrench comprising a cam-type torque detection mechanism, the torque detection mechanism having a rotatable drive spindle for transmitting tightening force to a tightened member, a tubular cam disposed rotatably around the drive spindle via a ratchet mechanism and provided on its outer circumferential surface with a cam portion, and a roller member actuated by a resilient member to abut retreatably against the cam portion, the roller member being subjected to the tightening force, the torque wrench characterized in that the cam portion has a cam top surface serving as a cam top portion for guiding the roller member after having passed the torque peak position, a gradually decreasing torque cam surface connected to the cam top surface for gradually decreasing a plus torque to zero to the roller member, and a minus torque cam surface for imparting a minus torque to the roller member after having passed over the gradually decreasing torque cam surface.

3. A torque wrench comprising a cam-type torque detection mechanism, the cam-type torque detection mechanism having a rotatable drive spindle for transmitting tightening force to a tightened member, a tubular cam disposed rotatably around the drive spindle via a ratchet mechanism and provided on its outer circumferential surface with a cam portion, and a roller member actuated by a resilient member to abut retreatably against the cam portion, the roller member being subjected to the tightening force, the torque wrench characterized in that the cam portion has a static engagement cam surface for engagement in a non-operated status by the roller member in a static status, a gradually increasing torque peak cam surface which is connected to the static engagement cam surface and with which the roller member is brought into contact while moving to thereby gradually increase a torque peak, a cam top surface serving as a cam top portion connected to the gradually-increasing torque peak value cam surface, a gradually decreasing torque cam surface for gradually decreasing a plus torque to the roller member to zero, and a minus torque cam surface for imparting a minus torque to the roller member after having passed over the gradually decreasing torque cam surface.

4. The torque wrench according to claim 1, wherein the gradually increasing torque peak cam surface is made up of a straight locus.

5. The torque wrench according to claim 2, wherein the gradually decreasing torque cam surface is made up of a straight locus.

6. The torque wrench according to any claim 1, wherein the tubular cam is provided on its outer circumferential surface with a plurality of cam portions.

7. The torque wrench according to claim 1, comprising a tubular handle, and a head fixed to a front end of the handle, and wherein the drive spindle and the tubular cam are disposed within the head, and the resilient member disposed within the handle causes the roller member disposed in the head to abut against the cam portion.

* * * * *